US009344790B2

(12) United States Patent
Li

(10) Patent No.: US 9,344,790 B2
(45) Date of Patent: May 17, 2016

(54) AUDIO SIGNAL RECEIVING DEVICE, AUDIO SIGNAL ADAPTER DEVICE AND SYSTEM FOR TRANSMITTING AUDIO SIGNAL

(75) Inventor: Dongsheng Li, Beijing (CN)

(73) Assignee: Tendyron Corporation, Beijing (CN)

( * ) Notice: Subject to any disclaimer, the term of this patent is extended or adjusted under 35 U.S.C. 154(b) by 107 days.

(21) Appl. No.: 14/105,491

(22) PCT Filed: Jun. 15, 2012

(86) PCT No.: PCT/CN2012/077042

§ 371 (c)(1),
(2), (4) Date: Mar. 10, 2014

(87) PCT Pub. No.: WO2012/171496

PCT Pub. Date: Dec. 20, 2012

(65) Prior Publication Data

US 2014/0198928 A1 Jul. 17, 2014

(30) Foreign Application Priority Data

Jun. 15, 2011 (CN) ..... 2011 1 0161131

(51) Int. Cl.
*H04R 1/10* (2006.01)
*H04R 1/06* (2006.01)
(Continued)

(52) U.S. Cl.
CPC .. *H04R 1/06* (2013.01); *H04R 3/00* (2013.01); *H04R 5/04* (2013.01); *H04R 2201/107* (2013.01); *H04R 2420/03* (2013.01); *H04R 2420/09* (2013.01)

(58) Field of Classification Search
CPC ..... H04R 3/00; H04R 5/04; H04R 1/06; H04R 2420/09; H04R 2420/03; H04R 1/1041; H04R 2201/107; H04M 1/6041; H04M 1/6058
USPC ..... 381/74
See application file for complete search history.

(56) References Cited

U.S. PATENT DOCUMENTS

2006/0222021 A1* 10/2006 Ruff ..... 370/522
2008/0140887 A1* 6/2008 Gallant et al. ..... 710/100

FOREIGN PATENT DOCUMENTS

CN 1818889 A 8/2006
CN 1832631 A 9/2006
(Continued)

OTHER PUBLICATIONS

Kuo, Ye-Sheng, Sonal Verma, Thomas Schmid, and Prabal Dutta, "Hijacking Power and Bandwidth from the Mobile Phone's Audio Interface", Dec. 18, 2010, ACM DEV '10, pp. 1-10.*
(Continued)

*Primary Examiner* — Davetta W Goins
*Assistant Examiner* — Daniel Sellers
(74) *Attorney, Agent, or Firm* — Maginot, Moore & Beck, LLP

(57) ABSTRACT

An audio signal receiving device, an audio signal adapter device and a system for transmitting an audio signal are provided. The audio signal adapter device is connected with an audio signal sending device and the audio signal receiving device and is configured to transmit a signal between the audio signal sending device and the audio signal receiving device, and the device comprises: a loudspeaker interface having an audio pin, a ground pin and a MIC pin; and a adapter end interface having an audio signal pin, a reference signal pin and a ground pin. The audio signal pin of the adapter end interface is connected with the audio pin of the loudspeaker interface, the reference signal pin of the adapter end interface is connected with the ground pin of the loudspeaker interface, for sending the audio signal output from the audio signal sending device to the audio signal receiving device.

8 Claims, 6 Drawing Sheets

(51) Int. Cl.
*H04R 3/00* (2006.01)
*H04R 5/04* (2006.01)

(56) References Cited

FOREIGN PATENT DOCUMENTS

| | | | |
|---|---|---|---|
| CN | 1848530 | A | 10/2006 |
| CN | 101207255 | A | 6/2008 |
| CN | 101207256 | A | 6/2008 |
| CN | 101217225 | A | 7/2008 |
| CN | 101350989 | A | 1/2009 |
| CN | 102201826 | A | 9/2011 |
| CN | 102201827 | A | 9/2011 |
| CN | 102263347 | A | 11/2011 |
| CN | 102354883 | A | 2/2012 |
| CN | 102377088 | A | 3/2012 |
| KR | 10-2007-0081491 | A | 8/2007 |

OTHER PUBLICATIONS

English Translation of International Search Report and Written Opinion of the International Searching Authority corresponding to PCT/CN2012/077042, mailed Sep. 20, 2012 (15 pages).

* cited by examiner

AUDIO SIGNAL RECEIVING DEVICE, AUDIO SIGNAL ADAPTER DEVICE AND SYSTEM FOR TRANSMITTING AUDIO SIGNAL

FIELD

The present invention generally relates to an electronic technical field, and more particularly relates to an audio signal receiving device, and an audio signal adapter device and a system for transmitting an audio signal.

BACKGROUND

With the development of an audio signal coding/decoding technology, more and more electronic equipments transmitting data via an audio interface are produced. For example, the electronic equipment may be connected with a mobile communication device via a low-resistance voice coil type of loudspeaker interface (such as a headphone interface) of the mobile communication device (such as a mobile phone) for receiving an audio signal output from the mobile communication device.

As an output power of the low-resistance voice coil type of loudspeaker interface is usually very low, except the electronic equipment (such as a headphone) with low power consumption, the electronic equipment receiving the audio signal via the low-resistance voice coil type of loudspeaker interface generally needs to use an external power source or an internal battery for normal working, which increases a cost of the electronic equipment and enlarges a volume of the electronic equipment.

For solving the above problems, the inventors propose an audio signal adapter device (such as an audio cable) having a power supplying function, such that the audio signal adapter device can supply power to an audio signal receiving device at the same time when sending an audio signal to the audio signal receiving device.

FIG. 1 is a schematic diagram of an audio cable having a power supplying function. As shown in FIG. 1, the audio cable comprises: a loudspeaker interface (a headphone plug as shown in FIG. 1), a boosting unit (a boosting transformer as shown in FIG. 1), a rectifying unit (a rectifier as shown in FIG. 1), a filtering unit, and a USB plug.

The headphone plug is configured to be connected with a headphone jack of the audio signal sending device (such as the mobile phone), and to receive the audio signal output from the audio signal sending device.

The headphone plug comprises a left-channel pin, a right-channel pin, a ground pin, and a MIC pin.

The left-channel pin and the right-channel pin of the headphone plug are connected with one pin of a primary coil of the boosting transformer, and the ground pin of the headphone plug is connected with the other pin of the primary coil of the boosting transformer.

Furthermore, the ground pin of the headphone plug is further connected with a D− pin of the USB plug.

The boosting transformer comprises the primary coil and a secondary coil, and is configured to raise an input voltage (commonly about 1V) at an input end (the primary coil) to an output voltage (for example, larger than or equal to 5V) at an output end (the secondary coil).

As described above, the primary coil of the boosting transformer has two pins, one pin is connected with the left-channel pin and the right-channel pin of the headphone plug respectively, and the other pin is connected with the ground pin of the headphone plug.

The output coil of the boosting transformer has two output pins and one tap, the two output pins are connected with two input pins of an input end of the rectifier respectively, and the tap is connected with the ground pin of the USB plug.

The rectifier is configured to rectify an alternating current level input from the input end thereof, and to output the rectified level via an output end thereof.

The rectifier has two input pins of the input end, and one output pin of the output end; accordingly, the rectifier comprises two diodes, positive poles of the two diodes are connected with the two input pins of the rectifier respectively, and negative poles of the two diodes are connected with the output pin of the rectifier.

The filtering unit has an input end and an output end, and is configured to convert a level input from the input end to a smooth direct current level, and to output the smooth direct current level via the output end.

The input end of the filtering unit is connected with the output end of the rectifier, and the output end of the filtering unit is connected with a VBUS pin (a power pin) of the USB plug, via which a power is supplied to the audio signal receiving device connected with the USB plug.

The input end and the output end of the filtering unit are connected, and the filtering unit comprises a capacitor C1, one end of which is connected with the input/output end of the filtering unit, and the other end of which is connected with the ground pin of the USB plug.

Furthermore, the left-channel pin and the right-channel pin of the headphone plug are further connected with a D+ pin of the USB plug.

When the audio cable shown in FIG. 1 is connected with the electronic equipment, the headphone plug of the audio cable is plugged into the headphone jack of the audio signal sending device (such as the mobile phone), and the USB plug of the audio cable is plugged into the USB slot of the electronic equipment. Such that, the audio signal receiving device gains power via the VBUS pin of the USB socket/slot, meanwhile, uses the D+ pin as an audio signal pin and uses the D− pin as a reference signal pin, so as to receive the audio signal output from the headphone jack of the audio signal sending device.

Furthermore, the structure of the audio cable shown in FIG. 1 may have a variety of variations as follows.

(1) using the D− pin of the USB socket as the audio signal pin, and using the D+ pin as the reference signal pin;

(2) connecting only one audio pin (such as the left-channel pin) of the headphone plug with the primary coil of the boosting transformer, and connecting the other audio pin (such as the right-channel pin) with the D+ pin only.

As described above, the audio cable shown in FIG. 1 can realize an adapter function between the headphone interface and the USB interface, and realize supplying power to the audio signal receiving device via the VBUS pin and the ground pin of the USB interface end (the USB plug).

However, when the audio cable shown in FIG. 1 is used, as the ground pin of the USB interface is occupied and the D+ pin and the D− pin are used as the audio signal pin and the reference signal pin of the audio signal receiving device respectively for receiving the audio signal, the MIC pin of the headphone plug cannot be connected with the audio signal receiving device, which makes the audio signal receiving device unable to send a signal to the audio signal sending device.

SUMMARY

The present disclosure overcomes the defects of the prior art, to provide an audio signal receiving device which can send a signal (MIC signal) to an audio signal sending device without increasing the number of the pins of the audio signal receiving device.

A new system for transmitting an audio signal is proposed. The system is configured to receive an audio signal output from an audio signal sending device and to send a signal to the audio signal sending device, and the system comprises an audio signal adapter device and an audio signal receiving device.

The audio signal adapter device comprises a loudspeaker interface and a adapter end interface.

The loudspeaker interface is connected with the audio signal sending device and has an audio pin, a first ground pin and a MIC pin.

The adapter end interface is connected with the audio signal receiving device and has a first audio signal pin, a first reference signal pin and a second ground pin.

The first audio signal pin of the adapter end interface is connected with the audio pin of the loudspeaker interface, and the first reference signal pin of the adapter end interface is connected with the first ground pin of the loudspeaker interface.

The MIC pin of the loudspeaker interface is connected with the second ground pin of the adapter end interface.

The audio signal receiving device comprises an audio signal receiving module, a signal sending module and a receiving end interface.

The receiving end interface is connected with the adapter end interface and has a second audio signal pin, a second reference signal pin and a third ground pin.

The audio signal receiving module is connected with the second audio signal pin and the second reference signal pin of the receiving end interface respectively, and is configured to receive the audio signal output from the audio signal sending device.

The signal sending module is connected with the second reference signal pin of the receiving end interface, and is configured to send a signal to the audio signal sending device by varying a voltage of the second reference signal pin.

Furthermore, the signal sending module is further connected with the second audio signal pin of the receiving end interface, and configured to vary a voltage of the second audio signal pin with an amplitude same as a vary of the voltage of the second reference signal pin.

Furthermore, the signal sending module is further connected with the third ground pin of the receiving end interface, and configured to keep a voltage of the third ground pin at a preset fixed voltage value when varying the voltage of the second reference signal pin.

Furthermore, the adapter end interface further comprises a power source pin, and the audio signal adapter device further comprises a power supply module.

The power supply module is connected with the power source pin and the second ground pin of the adapter end interface, is configured to supply power to the audio signal receiving device via the power source pin and the second ground pin of the adapter end interface.

Furthermore, the MIC pin of the loudspeaker interface is connected with the second ground pin of the adapter end interface via a capacitor.

Furthermore, the audio pin of the loudspeaker interface comprises a left-channel pin and/or a right-channel pin.

Furthermore, each of the adapter end interface and the receiving end interface is configured as a USB interface.

Each of the first audio signal pin and the second audio signal pin is one of a D+ pin and a D− pin, and each of the first reference signal pin and the second reference signal pin is the other one of the D+ pin and the D− pin.

The present disclosure further provides an audio signal adapter device connected with an audio signal sending device and an audio signal receiving device respectively and configured to transmit a signal between the audio signal sending device and the audio signal receiving device, and the audio adapter device comprises a loudspeaker interface and a adapter end interface.

The loudspeaker interface is connected with a headphone jack of the audio signal sending device, and has an audio pin, a first ground pin and a MIC pin.

The adapter end interface is connected with a receiving end interface of the audio signal receiving device and comprises an audio signal pin, a reference signal pin and a second ground pin.

The audio signal pin of the adapter end interface is connected with the audio pin of the loudspeaker interface. The first reference signal pin of the adapter end interface is connected with the first ground pin of the loudspeaker interface, and is configured to the send the audio signal output from the audio signal sending device to the audio signal receiving device.

The MIC pin of the loudspeaker interface is connected with the second ground pin of the adapter end interface. The MIC pin and the first ground pin of the loudspeaker interface are configured to transmit a signal output from the audio signal receiving device to the audio signal sending device.

Furthermore, the adapter end interface further comprises a power source pin, and the audio signal adapter device further comprises a power supply module.

The power supply module is connected with the power source pin and the second ground pin of the adapter end interface, and is configured to supply power for the audio signal receiving device via the power source pin and the second ground pin.

Furthermore, the MIC pin of the loudspeaker interface is connected with the second ground pin of the adapter end interface via a capacitor.

Furthermore, the audio pin of the loudspeaker interface comprises a left-channel pin and/or a right-channel pin.

Furthermore, the adapter end interface is a USB interface.

The first audio signal pin of the adapter end interface is one of a D+ pin and a D− pin, and the first reference signal pin of the adapter end interface is the other one of the D+ pin and the D− pin.

The present disclosure further provides an audio signal receiving device. The audio signal receiving device comprises an audio signal receiving module and a signal sending module. The audio signal receiving device further comprises a receiving end interface.

The audio signal receiving module is connected with an audio signal pin and a reference signal pin of the receiving end interface, and is configured to receive an audio signal output from the audio signal sending device connected therewith.

The signal sending module is connected with the reference signal pin of the receiving end interface, and is configured to send a signal to the audio signal sending device by varying a voltage of the reference signal pin.

Furthermore, the signal sending module is further connected with the audio signal pin of the receiving end interface, and is configured to vary a voltage of the audio signal pin with an amplitude same as a variation of the voltage of the reference signal pin.

Furthermore, the signal sending module is further connected with the ground pin of the receiving end interface, and is configured to keep a voltage of the ground pin at a preset fixed voltage value when varying the voltage of the reference signal pin.

Furthermore, the receiving end interface is a USB interface.

The audio signal pin of the receiving end interface is one of a D+ pin and a D− pin, and the reference signal pin of the receiving end interface is the other one of the D+ pin and the D− pin.

In conclusion, when the audio signal sending device using such as the headphone slot as an interface is connected with the audio signal receiving device using such as the USB socket as the interface via the audio signal adapter device (the audio cable or the audio adapter) of the present disclosure, on one hand, the audio signal adapter device sends the audio signal to the audio signal receiving device via the D+ pin and the D− pin of the USB interface end thereof and supplies power to the audio signal receiving device via the VBUS pin and the ground pin of the USB interface end; on the other hand, the audio signal adapter device receives the signal output from the audio signal receiving device via the D− pin or the D+ pin of the USB interface end, and outputs the signal to the audio signal sending device via the ground pin of the headphone interface end. In other words, the audio signal adapter device according to the present disclosure can realize two-way adapter function between the headphone interface device and the USB interface device with a relatively low cost, and realize the power supplying function via the audio signal to supply power to the USB interface device, which extends the function of the headphone interface device and the USB interface device.

Furthermore, the audio signal receiving device with the USB interface, used together with the audio signal adapter device (the audio cable or the audio adapter) of the present disclosure, can realize functions of getting power, receiving the audio signal and sending a signal via the four pins of the USB interface, without the need of increasing the number of pins, thus reducing the cost. Moreover, the audio signal receiving device with the USB interface can output a signal by varying levels both of D+ pin and D− pin with a same amplitude simultaneously, without influencing the audio signal receiving function.

DETAILED DESCRIPTION

The objective of the present disclosure is to output a signal from an audio signal receiving device by varying a level of a reference signal pin thereof, in which the audio signal receiving device gains power via a VBUS pin and a ground pin of a USB interface, uses one of the D+ pin and the D− pin of the USB interface as an audio signal pin, and uses the other as the reference signal pin. Meanwhile, in an audio signal adapter device (such as an audio cable) connected with the above audio signal receiving device, the pin (such as the D− pin) of the USB interface end (USB plug) used as the reference signal pin is connected with a ground pin of a headphone interface end (a headphone plug), and a MIC pin of the headphone interface end is connected with a ground pin of the USB interface end, such that an audio signal sending device (such as a mobile communication terminal) connected with the audio cable receives the signal via the MIC pin and the ground pin of the headphone interface.

In the following, the present disclosure will be described in detail with reference to drawings and embodiments.

First Embodiment

Figure 1:
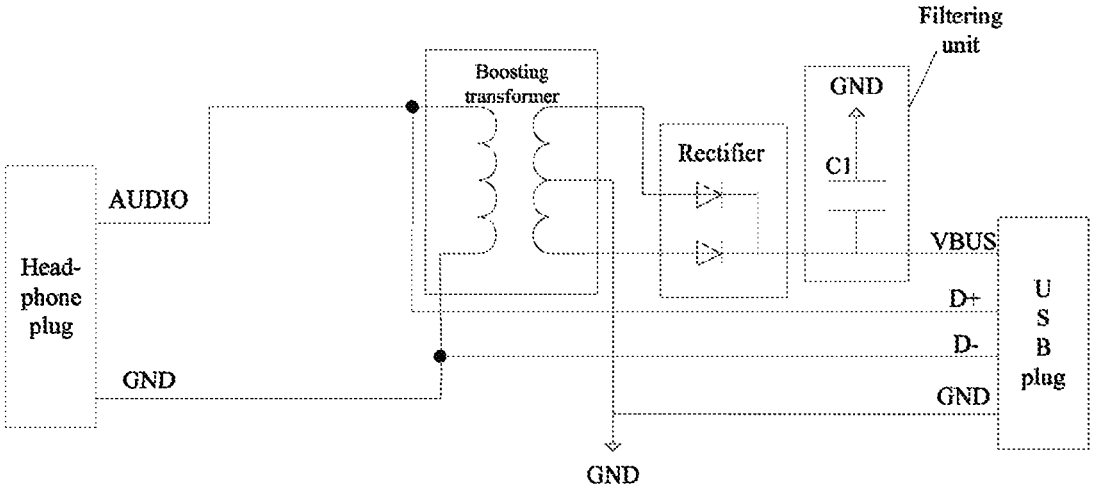
Fig. 1 (PRIOR ART)
FIG. 1 is a schematic diagram of an audio cable having a power supplying function.
Figure 2:
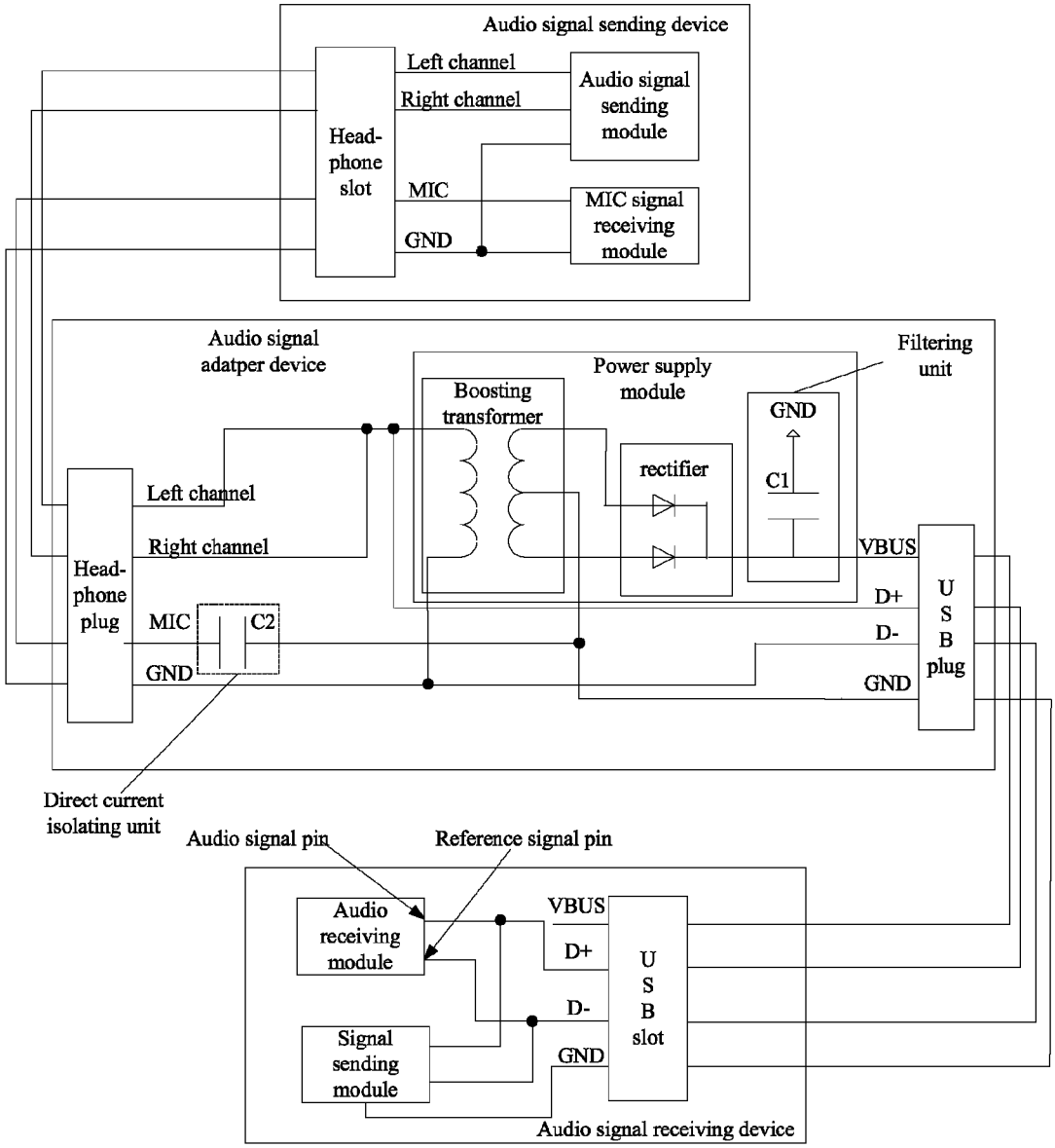
FIG. 2 is a schematic diagram of a system for transmitting an audio signal according to a first embodiment of the present disclosure.

FIG. 2 is a schematic diagram of a system for transmitting an audio signal according to the first embodiment of the present disclosure. As shown in FIG. 2, the system comprises an audio signal receiving device and an audio signal adapter device. The system is configured to receive an audio signal sent from an audio signal sending device via a headphone interface, and to transmit a signal to the audio signal sending device.

The audio signal sending device (such as a mobile communication terminal) comprises: an audio signal sending module, a MIC signal receiving module and a headphone slot.

The headphone slot comprises: audio signal pins (such as a left-channel pin and a right-channel pin), a MIC pin and a ground pin (a reference signal pin of the audio signal sending end).

The audio signal sending module is connected with the audio signal pins (such as the left-channel pin and the right-channel pin) and the ground pin of the headphone slot respectively, and configured to output the audio signal via the audio signal pin of the headphone slot and the reference signal pin of the audio signal sending end.

The detailed structure and functions of the audio signal sending module are known to those skilled in the art, and will be omitted herein.

The MIC signal receiving module is connected with the MIC pin and the ground pin of the headphone slot, and configured to receive a MIC signal via the MIC pin and the ground pin, and to identify the signal according to a difference between voltages of the MIC pin and the ground pin.

The power supply module comprises a boosting transformer, a rectifier and a filtering unit.

The detailed structure and functions of the MIC signal receiving module are known to those skilled in the art, and will be omitted herein.

The audio signal adapter device (such as an audio cable) comprises a headphone plug, a power supply module and a USB plug. Alternatively, the audio signal adapter device may further comprise a direct current isolating unit.

The headphone plug has an audio signal pin (such as a left-channel pin and a right-channel pin), a MIC pin and a ground pin.

The USB plug has a VBUS pin, a D+ pin, a D− pin and a ground pin.

In this embodiment, the audio signal pin (the left-channel pin and/or the right-channel pin) of the headphone plug is connected with the D+ pin of the USB plug, and the ground pin of the headphone plug is connected with the D− pin of the USB plug.

Furthermore, the MIC pin of the headphone plug is connected with the ground pin of the USB plug.

The detailed functions and connection relationships between various units in the power supply module are described above, and will be omitted herein.

Alternatively, the MIC pin of the headphone plug may be connected with the ground pin of the USB plug via the direct current isolating unit; i.e. one end of the direct current isolating unit is connected with the MIC pin of the headphone plug, and the other end of the direct current isolating unit is connected with the ground pin of the USB plug for isolating the direct current level.

The audio signal receiving device comprises a USB slot, an audio receiving module and a signal sending module.

The USB slot has a VBUS pin, a D+ pin, a D− pin and a ground pin.

The VBUS pin in the USB slot is configured to supply power for the audio signal receiving device.

In this embodiment, the audio receiving module is connected with the D+ pin and the D− pin of the USB slot respectively, and the D+ pin and the D− pin of the USB slot are used as an audio signal pin of the headphone slot and a reference signal pin of the audio signal receiving end respectively to receive the audio signal.

Figure 2A:
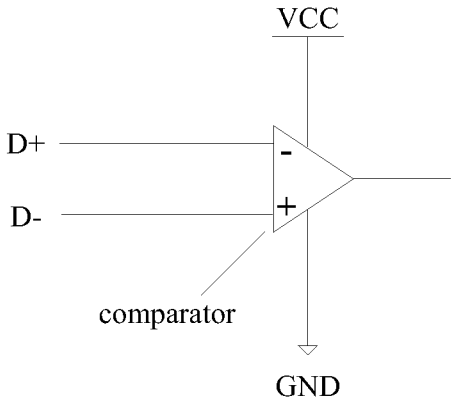
FIG. 2*a* is a schematic diagram showing an audio signal receiving module configured to receive a differential signal.

FIG. 2*a* is a schematic diagram showing an audio signal receiving module configured to receive a differential signal As shown in FIG. 2*a*, the above audio receiving module includes a comparator. A positive electrode and a negative electrode of the comparator are connected with the D+ pin and the D− pin of the USB slot respectively, a ground pin of the comparator is connected to ground, a power pin of the comparator is connected with a power supply, an output pin of the comparator is configured to output a square wave corresponding to an input audio signal.

The audio signal sending module can output a signal via one of the D+ pin and the D− pin which is used as the reference signal pin.

In this embodiment, the audio signal sending module is connected with the D+ pin and the D− pin of the USB slot, and may output the signal by varying the levels both of D+ pin and D− pin with the same amplitude simultaneously.

Furthermore, the audio signal sending module is further connected with the ground pin of the USB slot to keep a voltage of the ground pin of the USB slot at a preset fixed voltage value.

It should be noted that, as the audio receiving module identifies the audio signal according to the difference between the voltages of the D+ pin and the D− pin of the USB slot, in this embodiment, when the signal sending module outputs a signal by varying the levels both of the D+ pin and the D− pin with the same amplitude simultaneously, the audio signal receiving of the audio receiving module will not be influenced. When it is not necessary to consider whether the receiving of the audio receiving module is influenced (for example, when the audio receiving module stops receiving the audio signal), the signal sending module can output a signal normally as long as it vary the level of the D− pin (the reference signal pin of the audio signal receiving end) and keeps the voltage of the ground pin at the preset fixed voltage value.

Second Embodiment

Figure 3:
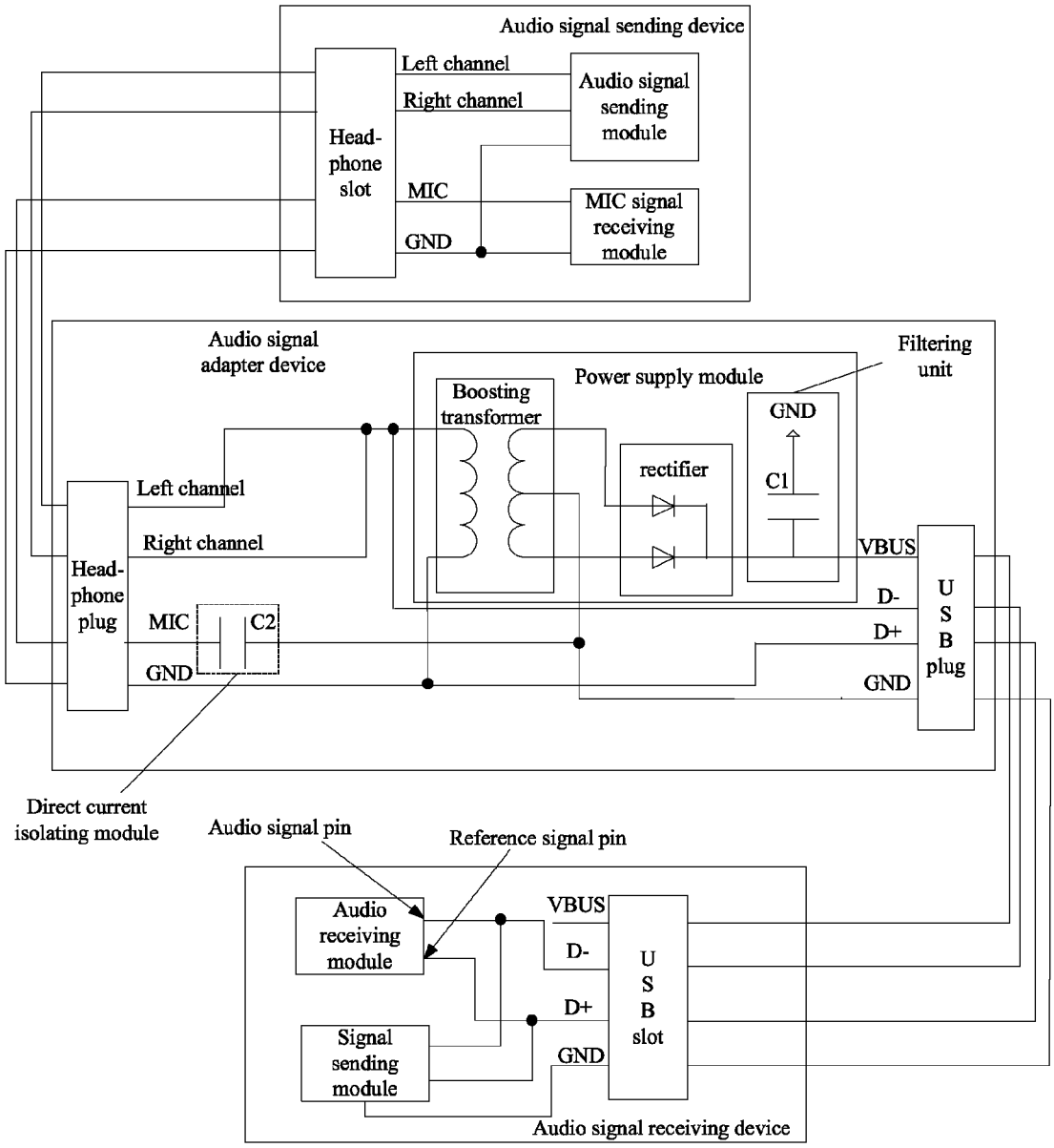
FIG. 3 is a schematic diagram of a system for transmitting an audio signal according to a second embodiment of the present disclosure.

FIG. 3 is a schematic diagram of a system for transmitting an audio signal according to the second embodiment of the present disclosure. As shown in FIG. 3, the differences between the second embodiment and the first embodiment are as follows.

In the audio signal adapter device in the second embodiment, the audio signal pin (the left-channel pin and/or the right-channel pin) of the headphone interface end (the headphone plug) is connected with the D− pin of the USB interface end (USB plug), and the ground pin of the headphone plug is connected with the D+ pin of the USB plug.

Accordingly, in the audio signal receiving device in the second embodiment, the audio receiving module uses the D− pin and the D+ pin as the audio signal pin of the headphone slot and the reference signal pin of the audio signal receiving end respectively to receive the audio signal. When it is not necessary to consider whether the receiving of the audio receiving module is influenced, the audio signal sending module can output the signal normally as long as it varies the level of the D+ pin (the reference signal pin of the audio signal receiving end).

Except for the above differences, the functions of various modules and the connection relationships between them in the second embodiment are the same as those in the first embodiment.

Third Embodiment

Figure 4:
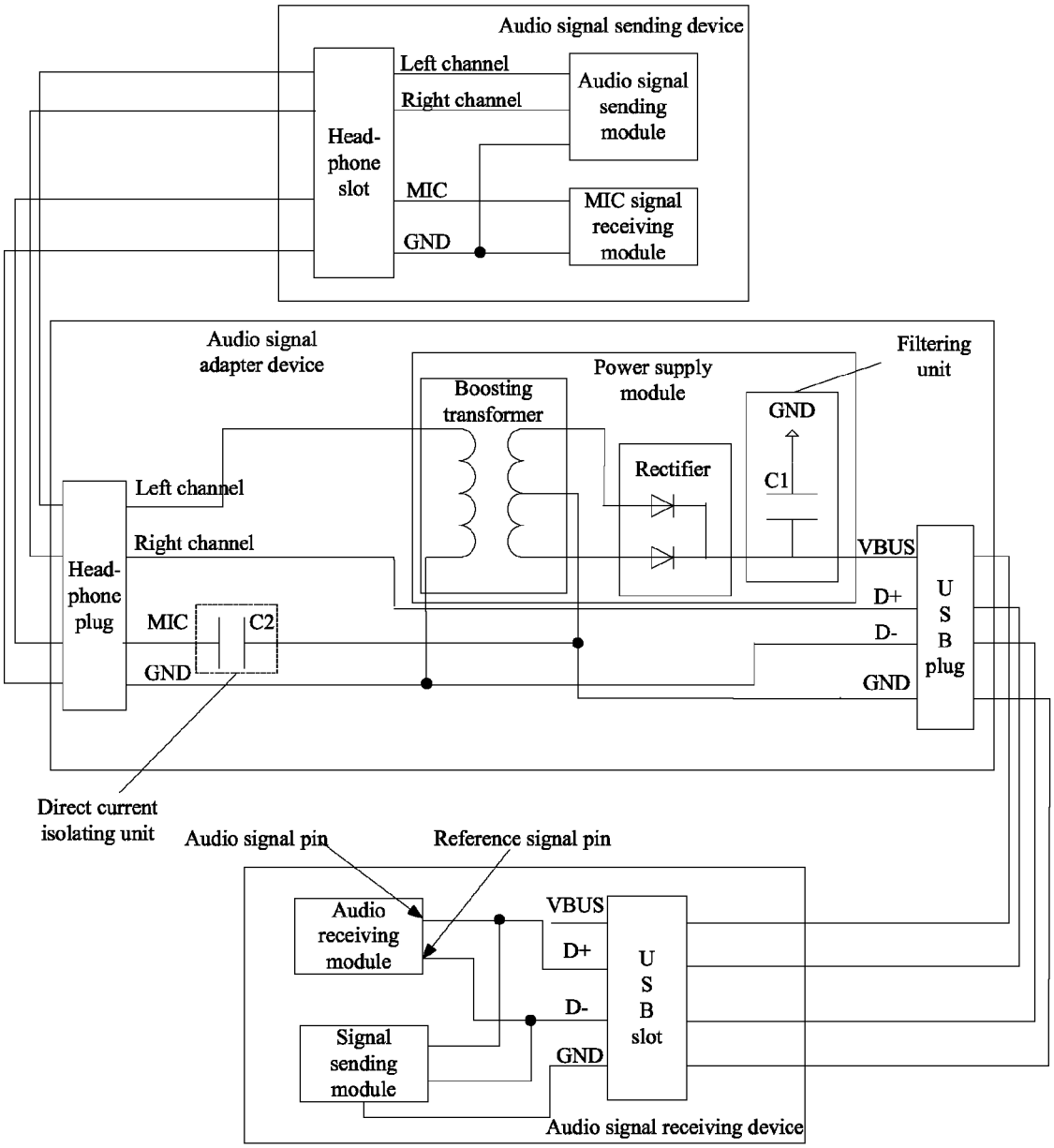
FIG. 4 is a schematic diagram of a system for transmitting an audio signal according to a third embodiment of the present disclosure.

FIG. 4 is a schematic diagram of a system for transmitting an audio signal according to the third embodiment of the present disclosure. As shown in FIG. 4, the differences between the third embodiment and the first embodiment are as follows.

One audio pin (such as the left-channel pin) of the headphone plug of the audio signal adapter device in FIG. 4 is connected with the primary coil pin of the boosting transformer, and the other audio pin (such as the right-channel pin) is only connected with the D+ pin of the USB plug.

In conclusion, when the audio signal sending device using such as the headphone slot as an interface is connected with the audio signal receiving device using such as the USB socket as the interface via the audio signal adapter device (the audio cable or the audio adapter) of the present disclosure, on one hand, the audio signal adapter device sends the audio signal to the audio signal receiving device via the D+ pin and the D− pin of the USB interface end thereof and supplies power to the audio signal receiving device via the VBUS pin and the ground pin of the USB interface end; on the other hand, the audio signal adapter device receives the signal output from the audio signal receiving device via the D− pin or the D+ pin of the USB interface end, and outputs the signal to the audio signal sending device via the ground pin of the headphone interface end. In other words, the audio signal adapter device according to the present disclosure can realize two-way adapter function between the headphone interface device and the USB interface device with a relatively low cost, and realize the power supplying function to supply power to the USB interface device, which extends the function of the headphone interface device and the USB interface device.

Furthermore, the audio signal receiving device with the USB interface, used together with the audio signal adapter device (the audio cable or the audio adapter) of the present disclosure, can realizes functions of getting power, receiving the audio signal and sending a signal via the four pins of the USB interface, without the need of increasing the number of pins, thus reducing the cost. Moreover, the audio signal receiving device with the USB interface can output a signal by varying levels both of D+ pin and D− pin with a same amplitude simultaneously, without influencing the audio signal receiving function.

Furthermore, the above loudspeaker interface may be fixed on the audio signal sending device.

The above loudspeaker interface may comprise a plurality of plugs, such as an audio signal plug comprising an audio signal input pin and a MIC plug comprising the MIC pin.

Furthermore, the USB plug of the audio signal adapter device may be replaced by the USB slot (may be collectively referred to as the USB adapter interface). Accordingly, the USB slot of the audio signal receiving device may be replaced by the USB plug (may be collectively referred to as the USB interface).

Figure 5:
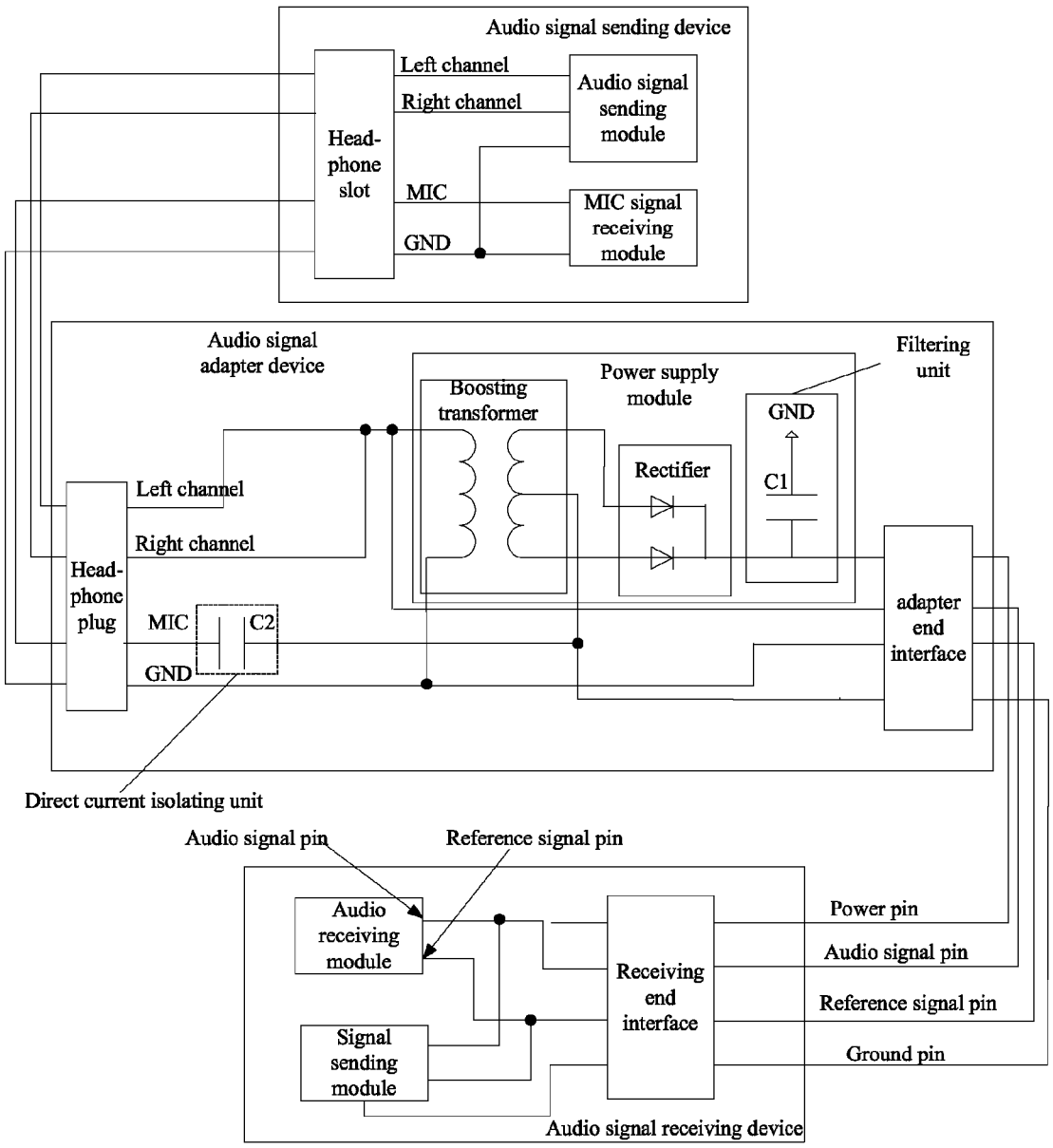
FIG. 5 is a schematic diagram of a system for transmitting an audio signal according to an embodiment of the present disclosure, in which the interfaces of the audio signal adapter device and of the audio signal receiving device are replaced by other type of interfaces having a power pin, an audio signal pin, a reference signal pin, and a ground pin.

As shown in FIG. 5, the interfaces used for connecting the audio signal adapter device and the audio signal receiving device of the present disclosure may be other types of interface having a power pin, an audio signal pin, a reference signal pin, and a ground pin. The above interface of the audio signal adapter device may be referred to as a adapter end interface, and the above interface of the audio signal receiving device may be referred to as a receiving end interface.

Those skilled in the art shall understand that all or parts of the steps in the above exemplifying method of the present disclosure may be achieved by commanding the related hardware with programs. The programs may be stored in a computer readable storage medium, and the programs comprise one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks or CD, etc.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A system for transmitting an audio signal, configured to receive an audio signal output from an audio signal sending device and to send a signal to the audio signal sending device, and comprising:

an audio signal adapter device including;

a loudspeaker interface connected with the audio signal sending device and having an audio pin, a first ground pin and a MIC pin, wherein the audio signal sending device comprises a headphone interface for outputting the audio signal, the loudspeaker interface is connected with the audio signal sending device via the headphone interface, one of the loudspeaker interface and the headphone interface is a headphone slot, and the other one of the loudspeaker interface and the headphone interface is a headphone plug; and an adapter end interface connected with an audio signal receiving device and having a first audio signal pin, a first reference signal pin, a second ground pin, wherein the first audio signal pin is connected with the audio pin of the loudspeaker interface, the first reference signal pin is connected with the first ground pin of the loudspeaker interface, and the second ground pin is connected with the MIC pin of the loudspeaker interface; and the audio signal receiving device including;

a receiving end interface connected with the adapter end interface and having a second audio signal pin, a second reference signal pin and a third ground pin;

an audio signal receiving module connected with the second audio signal pin and the second reference signal pin of the receiving end interface respectively, and configured to receive the audio signal output from the audio signal sending device;

a signal sending module connected with the second reference signal pin of the receiving end interface, and configured to send a signal to the audio signal sending device by varying a voltage of the second reference signal pin, wherein each of the adapter end interface and the receiving end interface is configured as a USB interface, and wherein each of the first audio signal pin and the second audio signal pin is one of a D+ pin and a D− pin, and each of the first reference signal pin and the second reference signal pin is the other one of the D+ pin and the D− pin, wherein the signal sending module is further connected with the second audio signal pin, and is configured to vary a voltage of the second audio signal pin with an amplitude that is the same as a variation of the voltage of the second reference signal pin.

2. The system according to claim 1, wherein the signal sending module is further connected with the third ground pin of the receiving end interface, and configured to keep a voltage of the third ground pin at a preset fixed voltage value when varying the voltage of the second reference signal pin.

3. The system according to claim 1, wherein the adapter end interface further comprises a power source pin, and the audio signal adapter device further comprises a power supply module connected with the power source pin and the second ground pin of the adapter end interface and configured to supply power to the audio signal receiving device via the power source pin and the second ground pin of the adapter end interface.

4. The system according to claim 1, wherein the MIC pin of the loudspeaker interface is connected with the second ground pin of the adapter end interface via a capacitor.

5. The system according to claim 1, wherein the audio pin of the loudspeaker interface comprises a left-channel pin and/or a right-channel pin.

6. An audio signal receiving device, comprising:

a receiving end interface, having an audio signal pin, a reference signal pin and a ground pin;

an audio signal receiving module connected with an audio signal pin and a reference signal pin of the receiving end interface, and configured to receive an audio signal output from an audio signal sending device; and a signal sending module connected with the reference signal pin of the receiving end interface, and configured to send a signal to the audio signal sending device by varying a voltage of the reference signal pin, wherein the signal sending module is further connected with the audio signal pin of the receiving end interface, and configured to vary a voltage of the audio signal pin with an amplitude that is the same as a variation of the voltage of the reference signal pin.

7. The audio signal receiving device according to claim 6, wherein, the signal sending module is further connected with the ground pin of the receiving end interface, and configured to keep a voltage of the ground pin at a preset fixed voltage value when varying the voltage of the reference signal pin.

8. The audio signal receiving device according to claim 6, wherein, the receiving end interface is a USB interface; and the audio signal pin of the receiving end interface is one of a D+ pin and a D− pin, and the reference signal pin of the receiving end interface is the other one of the D+ pin and the D− pin.

* * * * *